US007281337B1

(12) United States Patent
Oehlke et al.

(10) Patent No.: US 7,281,337 B1
(45) Date of Patent: Oct. 16, 2007

(54) TEMPLATE FOR CUSTOMIZING QUILTING SQUARES AND METHOD OF USING THE SAME

(75) Inventors: Vicki L. Oehlke, Devils Lake, ND (US); Sonja S. Moen, Devils Lake, ND (US)

(73) Assignee: WBL Enterprise, LLC, Devils Lake, ND (US)

( * ) Notice: Subject to any disclaimer, the term of this patent is extended or adjusted under 35 U.S.C. 154(b) by 39 days.

(21) Appl. No.: 11/277,126

(22) Filed: Mar. 21, 2006

(51) Int. Cl.
*A41H 3/01* (2006.01)
*G01B 3/14* (2006.01)

(52) U.S. Cl. ..... 33/566

(58) Field of Classification Search ..... 33/562, 33/563, 565, 566
See application file for complete search history.

(56) References Cited

U.S. PATENT DOCUMENTS 387,284 A * 8/1888 Dupee ..... 33/562
D136,655 S * 11/1943 Eilert ..... 33/563
4,053,986 A * 10/1977 Axelrod ..... 33/17 R
4,642,896 A * 2/1987 Grimm ..... 33/17 R
4,912,850 A 4/1990 Gray
4,930,382 A * 6/1990 Collins ..... 33/562
4,945,642 A * 8/1990 Saulietis ..... 33/17 R
5,557,996 A * 9/1996 Reber et al. ..... 33/563
5,579,670 A * 12/1996 McCormick ..... 33/562
5,638,605 A 6/1997 Sligar
5,791,062 A 8/1998 Walker
6,321,457 B1 * 11/2001 Lariviere et al. ..... 33/562
6,321,458 B1 * 11/2001 Hess ..... 33/566
6,862,823 B2 3/2005 deCarteret
6,925,724 B2 * 8/2005 Tandy ..... 33/563
7,028,412 B2 * 4/2006 Boomershine ..... 33/526
2005/0257391 A1 * 11/2005 Driscoll ..... 33/566

* cited by examiner

*Primary Examiner*—Christopher W Fulton
(74) *Attorney, Agent, or Firm*—Sheridan Ross P.C.

(57) ABSTRACT

A template is provided that aids quilt member fabrication. More specifically, a template is provided for selective interconnection to layered fabric members wherein the template indicates the location for sewing and cutting individual fabric pieces that make up the layered fabric thereby yielding a composite quilt member.

18 Claims, 12 Drawing Sheets

100
132
104
128
124
108
Bend Angles
To Outside Corner
Cutting Line
2
©2005 Sonja Moen & Vicki Lynn Oehlke all rights reserved 100
120
108
124
112

100
140
136
112
144
116
134

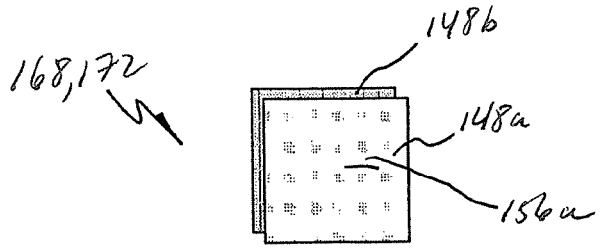
FIG. 7A
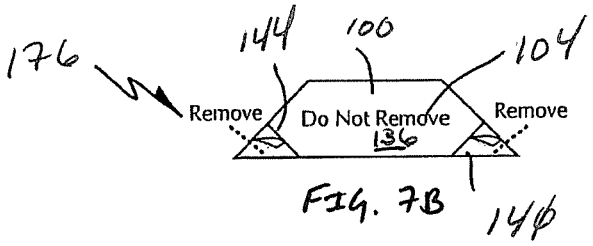
FIG. 7B
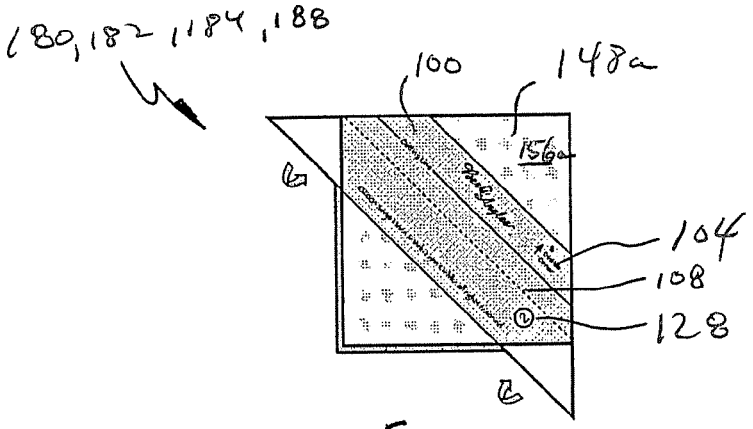
FIG. 7C
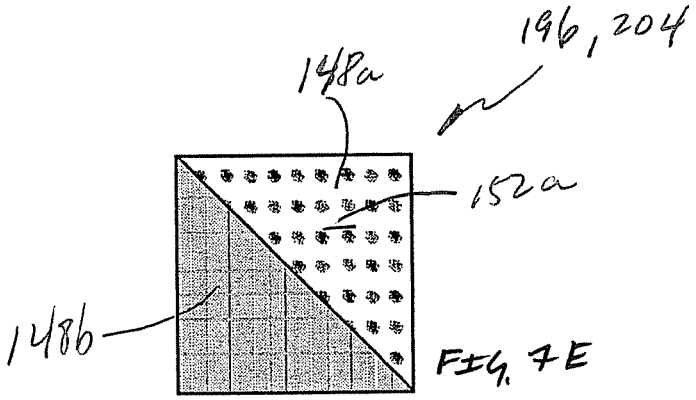
FIG. 7E
FIG. 7

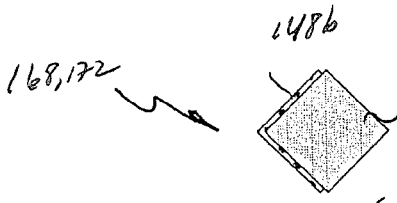
FIG. 13A
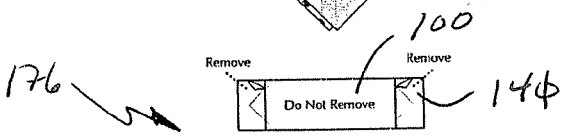
FIG. 13B
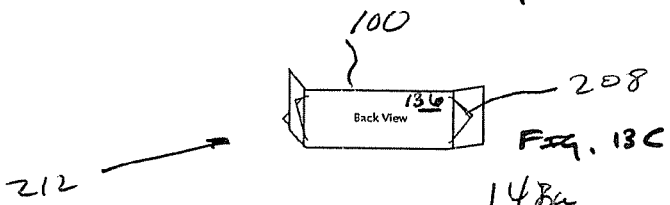
FIG. 13C
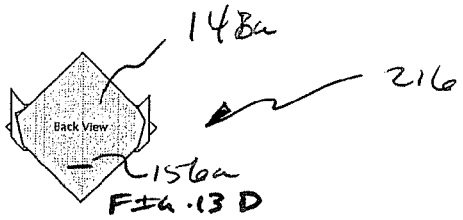
FIG. 13D
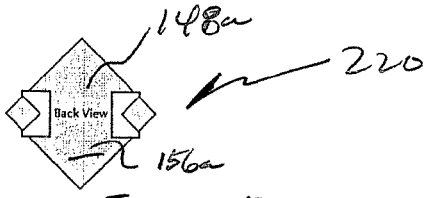
FIG. 13E
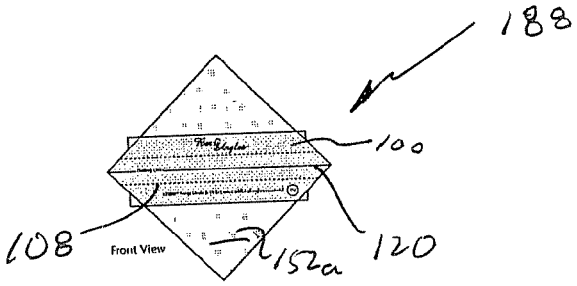
FIG. 13F
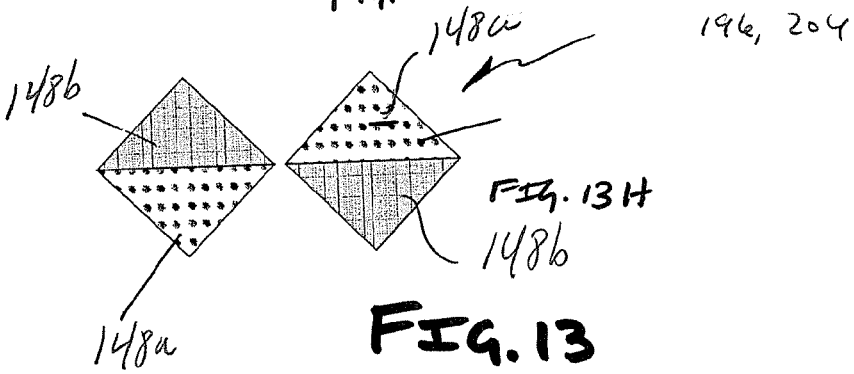
FIG. 13H
FIG. 13

TEMPLATE FOR CUSTOMIZING QUILTING SQUARES AND METHOD OF USING THE SAME

FIELD OF THE INVENTION

The present invention is generally related to quilting aids. More specifically, a template is provided for fabricating multi-pieced fabric members that are used to form a decorative portion of a quilt.

BACKGROUND OF THE INVENTION

Quilts are partially comprised of a predetermined arrangement of individual pieces of fabric. More specifically, quilts have a top layer, which is usually a decorated, layer of cotton or other soft material, and a bottom layer. The top layer has individual pieces of fabric that are interconnected to form larger blocks. A number of larger blocks are arranged to form the top layer of the quilt. Often, the individual fabric pieces that form the blocks are arranged to form commonly known designs, such as Crazy Ann, Granny's Flower Garden, Interlaced Block, Queen Charlotte's Crown, Yankee Puzzle, Attic Windows, Cathedral Windows, Dutchmen's Puzzle, Flying Geese, Snow birds, Baby Blocks, Basket Weave, Garden Maze, Real Fence, Snowball, Thousand Pyramids, Tumblers, and Yo-Yos, to name a few. Most block designs require the use of precisely cut triangles that are sewn onto another piece of fabric to create the desired effect. For example, half square triangles are often used as a base shape wherein a triangle piece of fabric is sewn onto a square piece at fabric along the hypotenuse of the triangle. Half square triangles are difficult to create since the diagonal seam is placed where the fabric has the most stretch, i.e. on the bias. The seam can thus stretch out of shape during sewing and pressing, thereby making the finished product unacceptable. It is one goal of quilt makers to stabilize this diagonal seam.

The prior art includes the use of a paper template to help position fabric pieces in relation to each other to aid in the fabrication of quilting block components. However, there are a few drawbacks of using a simple paper template to create the desired design. Paper templates are not easily positionable and securable to the pre-sewn fabric layers. Thus, when the fabric layers are sewn together, slippage may occur that will influence the finished product. Paper templates often require the quilt maker to add his or her own cut lines and other indicia with a fabric pencil or other means that aid them in making fabric squares. Lines of this nature are often difficult to see by one of diminishing sight thereby making it difficult to ascertain where to cut the individual fabric squares to yield the desired design. Further, some paper squares employ the use of pins to interconnect them with the fabric to be modified. The use of pins by individuals with lower than normal motor capability may be difficult, and pins still fail to prevent fabric pieces from slipping in relation to each other during sewing. In addition, pins often cause injuries to individuals. Finally, some of the templates used in the art are not applicable for commonly used patterns such as the snowball, flying geese, etc.

Thus there is a long felt need in the art of quilting to provide a template for selectively altering a piece of fabric for use in a quilting block. The following disclosure describes an improved template that is selectively interconnectable to layered fabric to prevent relative slippage of fabric pieces during sewing and cutting.

SUMMARY OF THE INVENTION

It is one aspect of the present invention to provide a template that facilitates joining and cutting pieces of fabric used to make quilting squares that are conglomerated to make a quilting block. More specifically, embodiments of the present invention are a template that includes instructions to identify the location for cutting and an indication of the size of the finished triangle. Thus embodiments of the present invention can decrease waste by reducing erroneous fabrication. Further, one embodiment of the present invention includes an adhesive side that allows the template to be selectively interconnected onto layered fabric pieces. The template may also include a backing portion that covers the adhesive until it is ready to be exposed and used during a project. Embodiments of the present invention further may include various score lines and kiss cuts to facilitate bending of the template around layered fabric pieces which will be described in greater detail below. Thus the template can make quilting square fabrication substantially error proof, that is, portions of the template are easily bendable in predetermined locations thereby allowing the backing to be removed from the template by individuals with less than ideal mobility in their hands. The score lines may include an indentation to allow for easy bending of the template to aid in interconnection to the fabric pieces. Cut lines and sew lines provided on the template can thus make it virtually impossible for the user to err in the construction of the block.

In another aspect of the present invention a template that is easily accessed and stored is provided. More specifically, the templates may be interconnected in a long line and stored in a roll. The templates may have perforated edges that allow for interconnection between two adjacent templates on a roll or a sheet, for example. When a template is required, one would simply pull the next template off the roll and tear it from its neighbor. Although a template with a backing has been described thus far, one skilled in the art will appreciate that templates may be employed that do not include a backing and are interconnected to each other as in a common roll of tape, for example. However, it is preferable to use at least some backing portion so that the template may be placed upon the fabric material without having to account for a large amount of adhesive that may lead to misplacement of the template onto the layered fabric pieces.

These and other advantages will be apparent from the disclosure of the invention(s) contained herein. The above-described embodiments and configurations are neither complete nor exhaustive. As will be appreciated, other embodiments of the invention are possible utilizing, alone or in combination, one or more of the features set forth above or described in detail below.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figures 1, 2, 3:
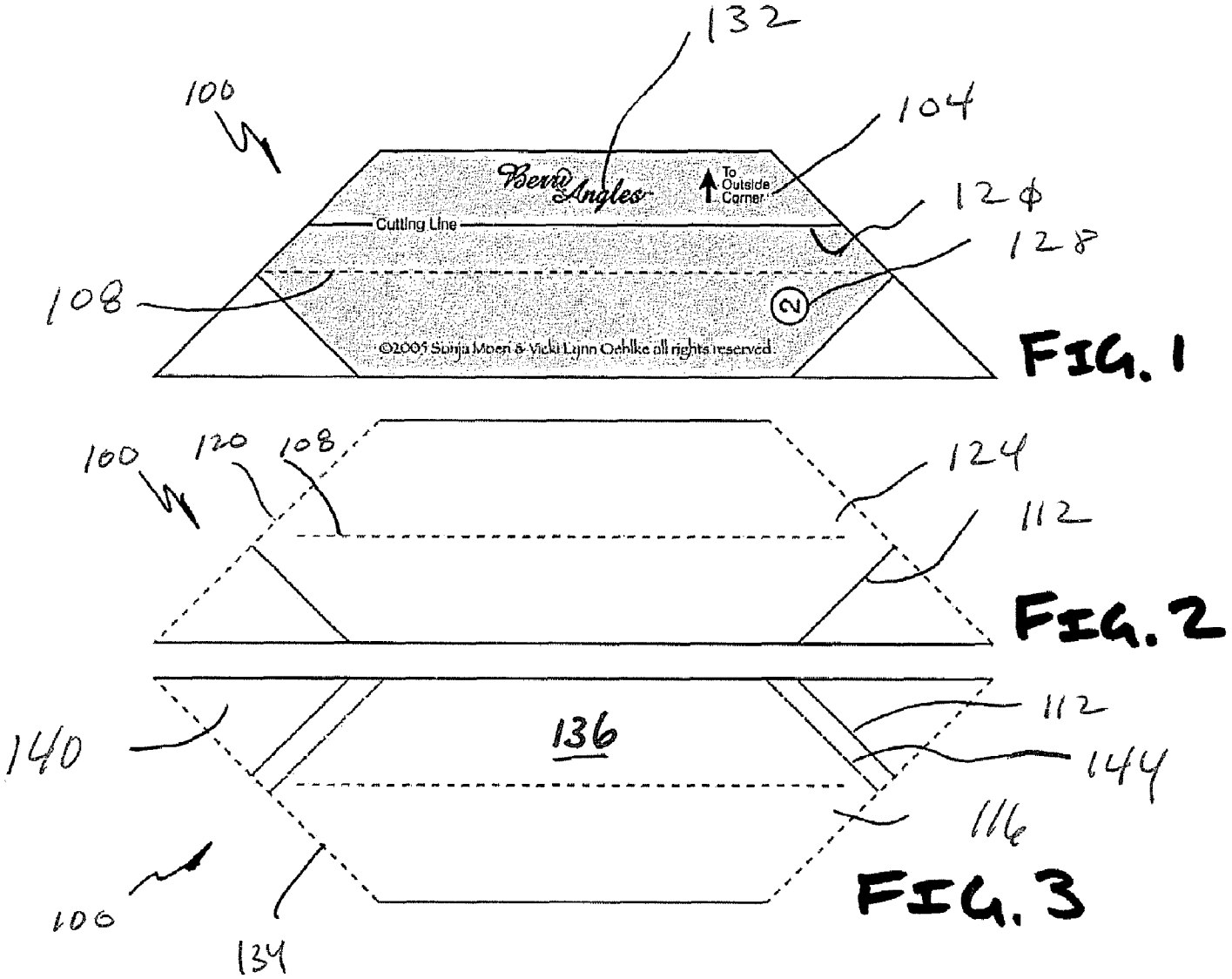
FIG. 1 is a front elevation view of a template of one embodiment of the present invention.
FIG. 2 is a simplified front elevation view of the template of one embodiment of the present invention.
FIG. 3 is a rear elevation view of the template of the embodiment shown in FIG. 2.

To assist in the understanding of the present invention the following list of components and associated numbering found in the drawings is provided herein:

| # | Component |
|---|---|
| 100 | Template |
| 104 | Instructions |
| 108 | Perforated line |
| 112 | Score |
| 114 | Full Cut Line |
| 116 | Backing |
| 120 | Cut line |
| 124 | Front of template |
| 128 | Size indicator |
| 132 | Logo |
| 134 | Edge cut line |
| 136 | Rear of template |
| 140 | Removable portion of the backing |
| 144 | Kiss cut line |
| 148 | Fabric square |
| 152 | Front of fabric square |
| 156 | Rear of fabric square |
| 160 | Larger fabric piece |
| 164 | Decorative side |
| 168 | Cut fabric |
| 172 | Align fabric |
| 176 | Remove portion of backing |
| 180 | Locate template |
| 184 | Secure template |
| 188 | Sew |
| 192 | Cut fabric |
| 196 | Remove template |
| 204 | Fold & press fabric |
| 208 | Slot |
| 212 | Bend portions of template |
| 216 | Locate fabric |
| 220 | Fold templates |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-13, a template 100 is shown that is selectively interconnected to layered fabric pieces to facilitate alterations of at least one of the fabric pieces. More specifically, commonly in the craft of quilt making, it is desirable to associate two separate pattern styles by modifying at least one of the styles and sewing it to the other pattern thereby providing a square or rectangle (hereinafter "square") to be used in a quilt blocks wherein a plurality of quilt blocks are sewn together to create at least one side of the finished quilt. Since the various sections of the quilt block are to be viewed as a whole, it is very important that the combinations of colors and designs of the plurality of squares are properly arranged within the finished block. Thus the template 100 is provided that includes instructions 104 and indicators that help an individual to accurately modify at least one fabric layer to provide a generally ideal portion of the quilt block. To that end, embodiments of the present invention provide a template 100 including perforated lines 108 and scores 112 to aid in the interconnection of the template 100 to fabric. In addition, embodiments of the present invention provide a removable backing 116 that covers an adhesive side of the template 100. The adhesive facilitates interconnection of the template 100 to fabric thereby substantially preventing movement of the template 100 and the layered pieces of fabric during sewing of the pieces of fabric and cutting of individual fabric pieces prior to completion of the decorative square.

Referring now specifically to FIGS. 1-3, a template 100 is provided that is adapted to interface with fabric to aid in the selective alteration thereof. It is to be understood that templates of the present invention may be of any shape even though the depicted template is trapezoidal with a perforated line 108 positioned between an upper and lower edge of the template 100. The perforated line 108 helps define the boundaries of a triangle when the template 100 is placed upon a piece of fabric. In addition, a cut line 120 is indicated on the template 100 that allows the user to cut and discard a portion of the fabric being modified. Further, the front side 124 of the template provides locations for instructions 104, size 128, and logos 132, thereby making the template 100 very user friendly. To facilitate storage of unused templates 100, cut lines 134 are provided on the template edges wherein a plurality of templates 100 may be operably interconnected and rolled. The back side 136 of the template 100 is generally composed of a backing sheet 116 that, when removed, exposes temporary adhesive that facilitates interconnection of the template 100 onto apiece of fabric. Preferably, the backing 116 is divided into removable portions 140 that are used to interconnect the template 100 onto apiece of fabric. In addition, kiss cut lines 144 and score lines 112 are provided that aid in selectively bending the template 100 to interface with the fabric by folding the template, which the fabric feature will be described in greater detail below.

Figure 4:
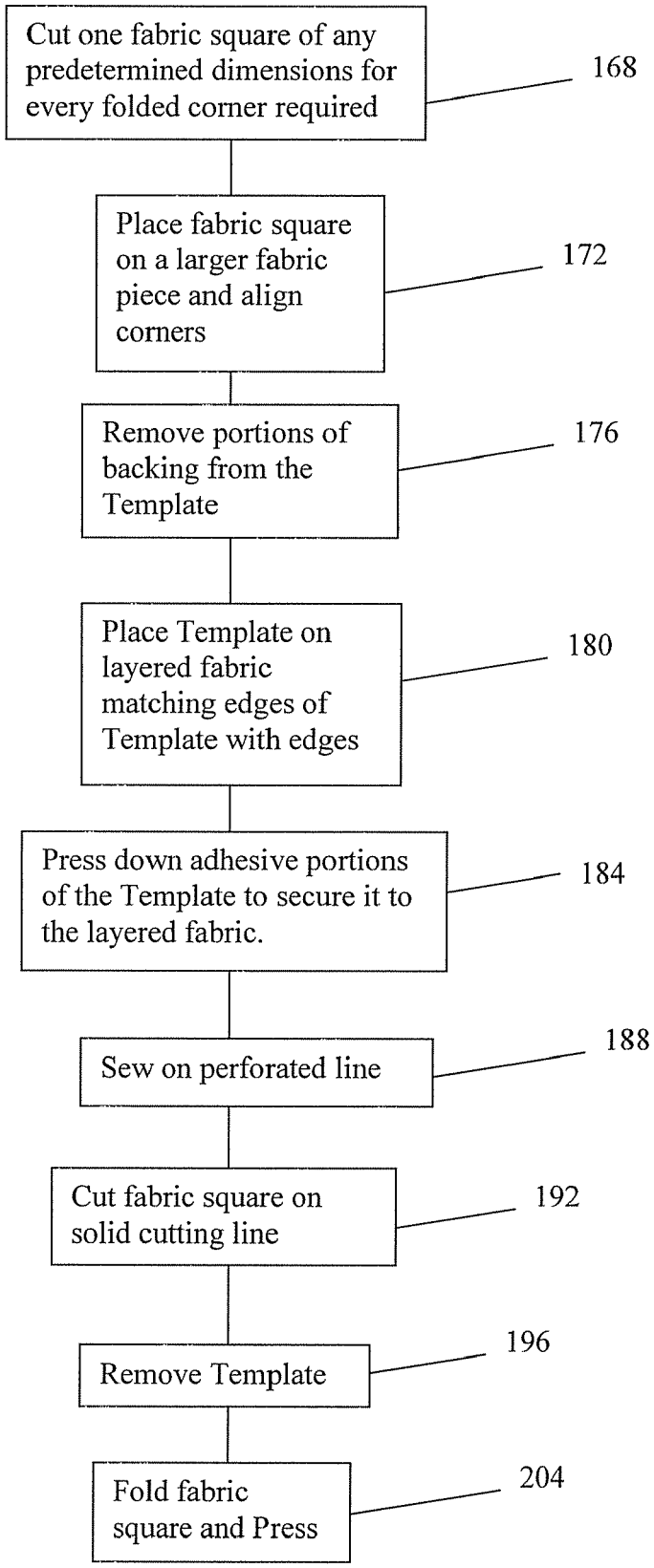
FIG. 4 is a flow diagram illustrating the method of using the embodiment of the present invention shown in FIG. 1.
Figure 5:
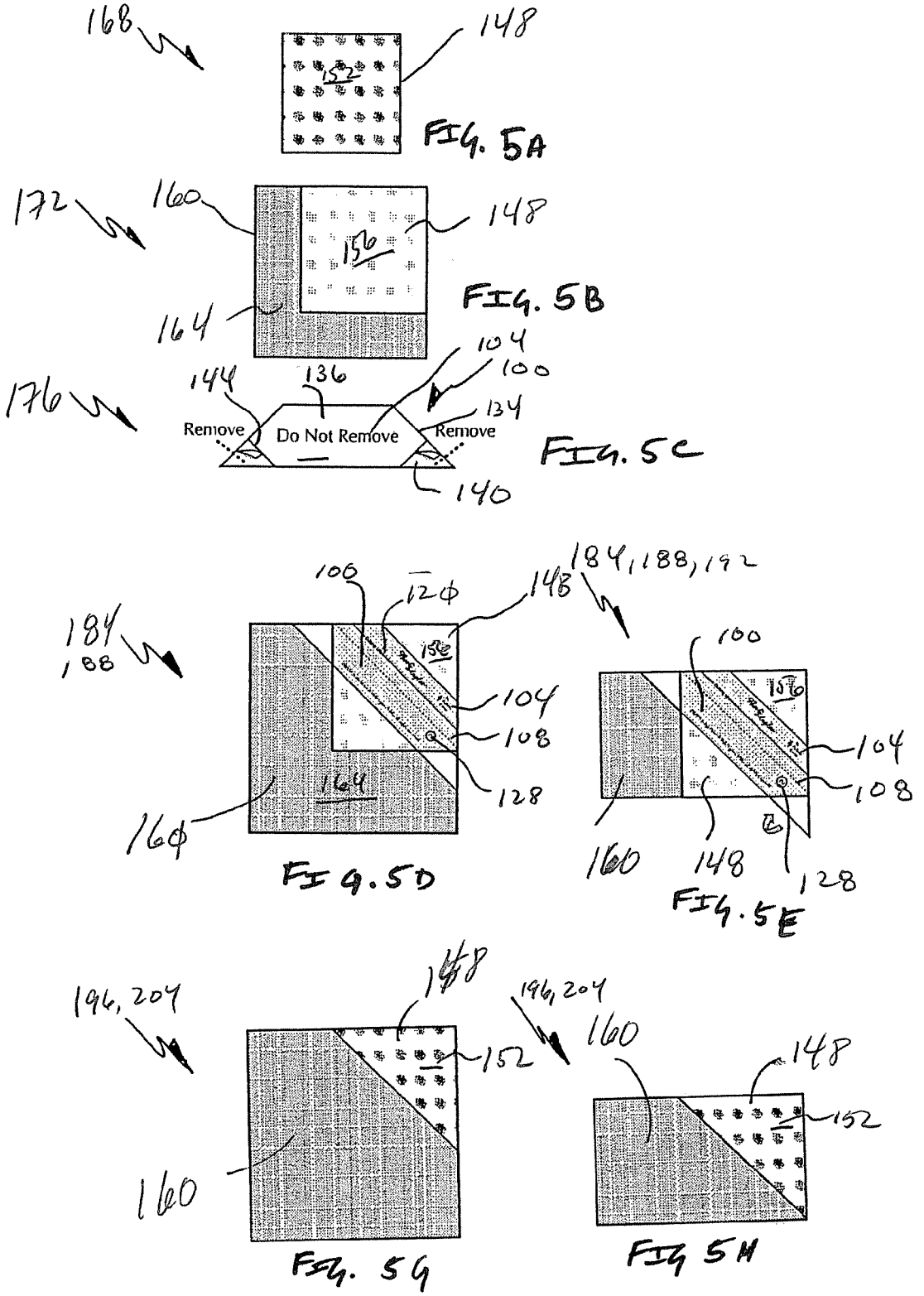
FIG. 5 is a series of pictorial representations of the flow shown in FIG. 4.
Figure 5F:
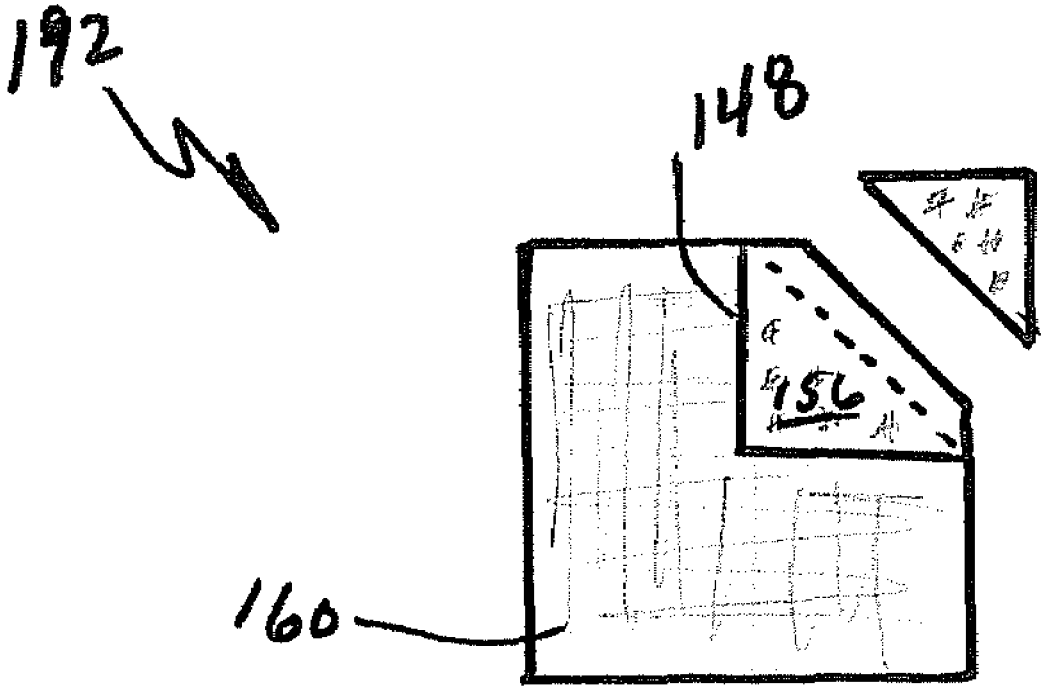

Referring now to FIGS. 4 and 5, one method of using the template 100 of one embodiment of the present invention is shown and described. More specifically, the first step is to define the desired arrangement of fabric that will be used to create at least a portion of a block used to form a side of a quilt. That is, a fabric square 148 having a front side 152 and a rear side 156 is provided and placed upon a larger fabric piece 160, wherein the front side of the fabric square 152 is mated to decorative side 164 of the larger fabric piece 160. (FIG. 5B) The fabric squares are previously cut to a predetermined dimension and are mated for every folded corner required as shown on block 168. The fabric square 148 is then aligned to the larger fabric piece 160 wherein two corners of the fabric square 148 and the larger fabric piece 160 are aligned, shown on block 172. Next, the removable portions 140 of the backing are removed from the template, shown on block 176. (FIG. 5C) Embodiments of the present invention may also include instructions 104 on the back side of the template 136 to allow the user to easily ascertain portions of the backing 116 that is to be removed and not to be removed. The template 100 is then reversed, front side up, and placed upon the layered fabric wherein the edges 134 of the template are aligned with the shared edges of the fabric square 148 and the larger fabric piece 160, shown on block 180. (FIGS. 5D & 5E) In this orientation, the perforated line provided on the template will generally span from one corner to another corner of the fabric square 148. Once the template 100 is aligned as described, the user presses down upon the portions of the template 100 having exposed adhesive, i.e., the portions where the backing 116 has been removed, to selectively interconnect the template 100 onto the larger fabric pieces 160, shown in block 164. If the larger fabric square 160 is of a shape, such as rectangular, a portion of the template 100 may not be entirely situated on to the layered fabric. In this situation, the user may fold a portion of the template 100 that is not situated on the layered fabric pieces behind the layered fabric pieces and press down to interconnect the adhesive to the larger fabric square 160. Next, the user sews the fabric square 148 onto the larger fabric square 160 along the perforated line 108 provided between the upper and lower edges of the template 100, as shown in block 188. The user then cuts along the indicated cut line 120 thereby disconnecting a portion of the fabric piece from the assemblage block 192. In addition, since the fabrics were sewn together along the perforated line 108, the template 100 may easily be split and removed from the sewn fabric pieces, block 196. Once the excess portion of fabric and the template 100 have been removed, the fabric square 148 may be folded to expose the front side 152 thereof to occupy the space vacated by the portion of the larger fabric piece 160 removed during the cutting step 162. To finish the process and to complete a multi-patterned piece for use in a quilting block, the layered fabric is pressed into generally one continuous square, block 204.

Figure 6:
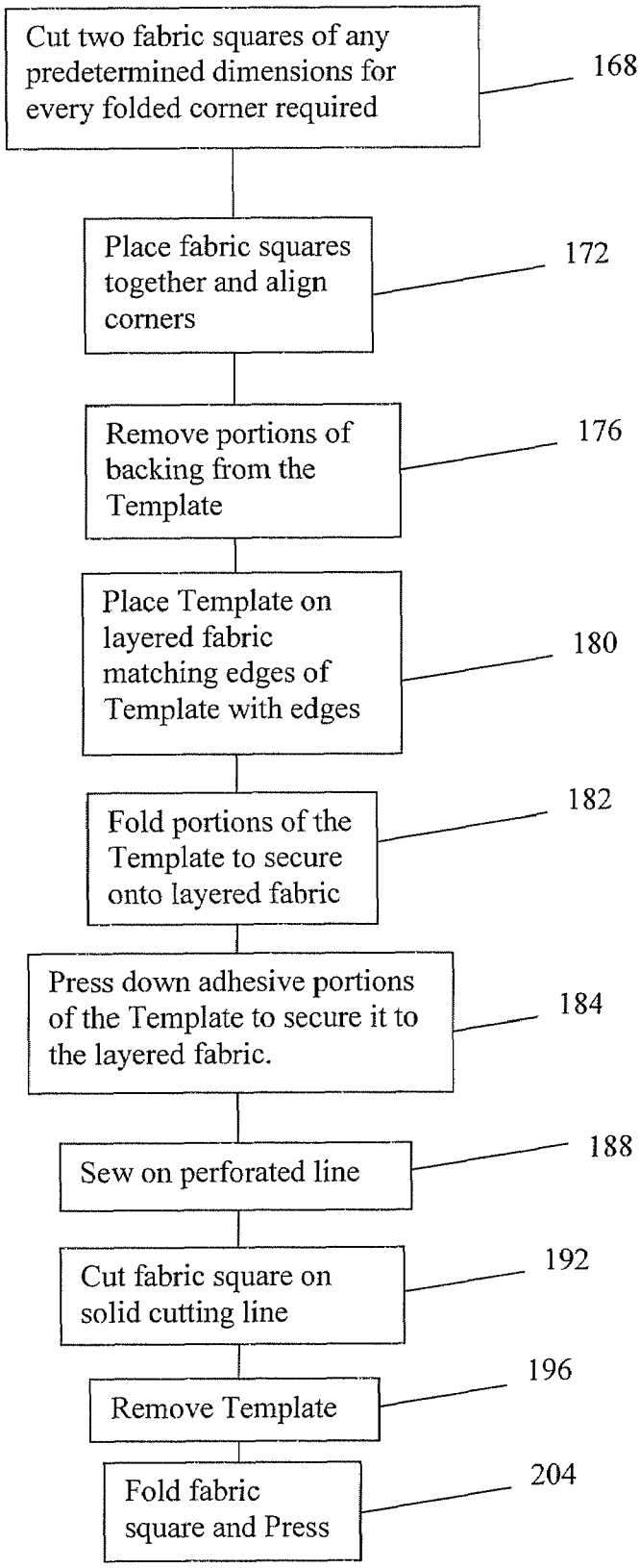
FIG. 6 is a flow diagram illustrating an alternative method of using the embodiment of the present invention shown in FIG. 1.
Figure 7D:
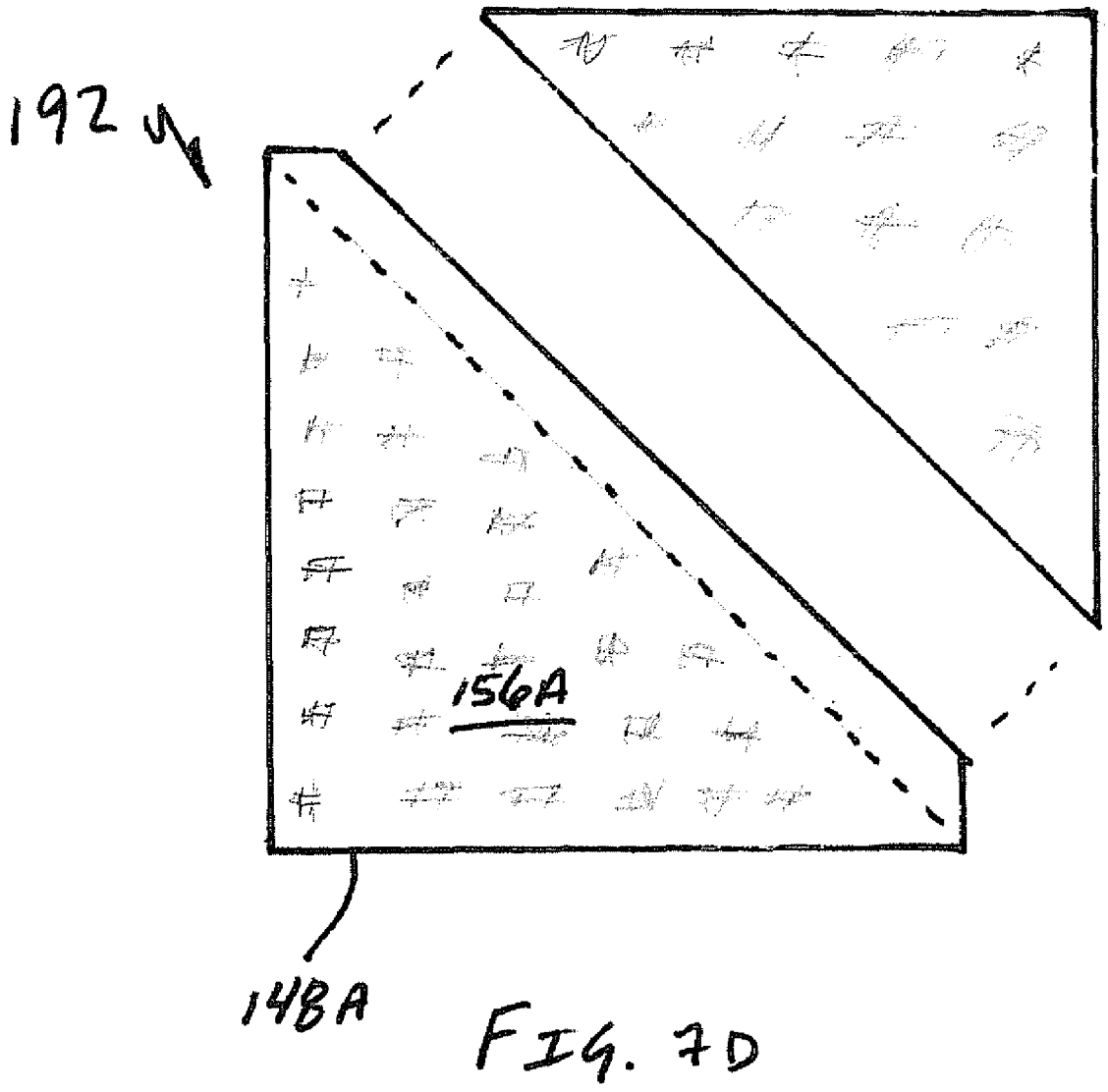
FIG. 7 is a series of pictorial representations of the flow shown in FIG. 6.
Figure 8:
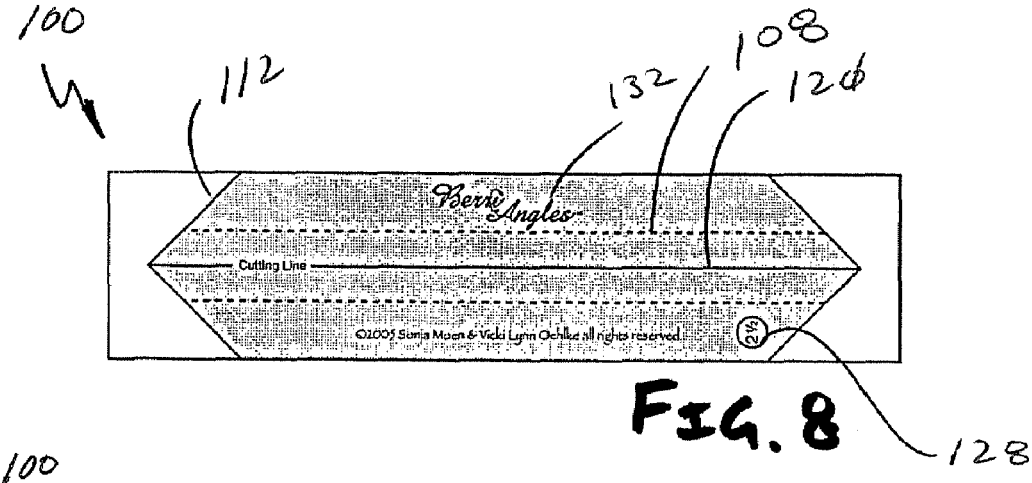
FIG. 8 is a front elevation view of a template of an alternative embodiment of the present invention.
Figure 9:
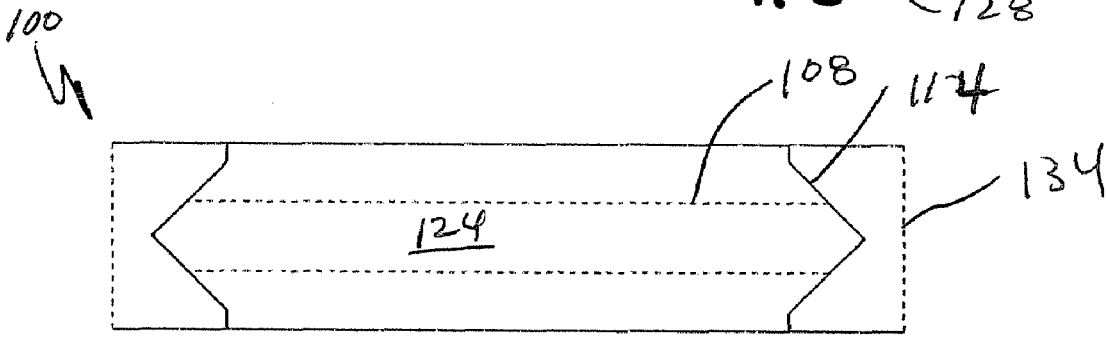
FIG. 9 is a simplified front elevation view of the template of an alternative embodiment of the present invention.
Figure 10:
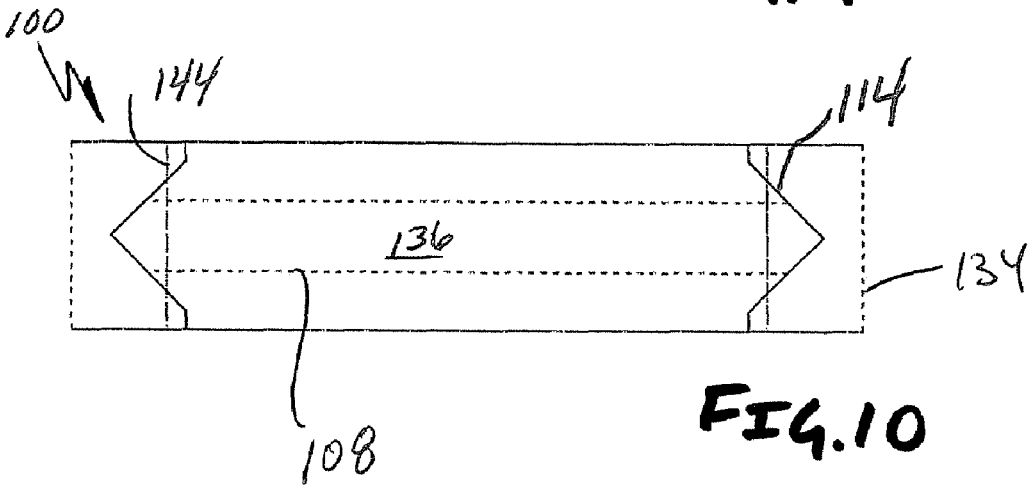
FIG. 10 is a rear elevation view of the template of the embodiment shown in FIG. 8.
Figure 11:
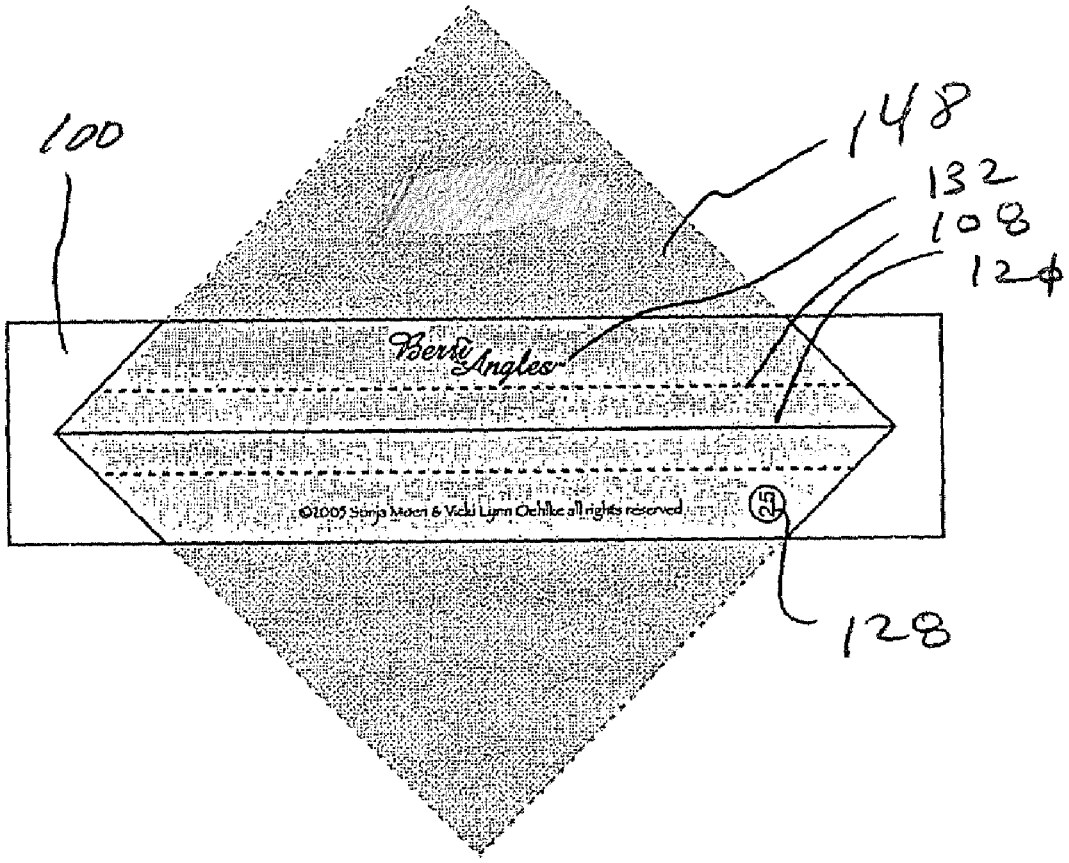
FIG. 11 is a front elevation view of the template shown in FIG. 8 positioned adjacent to a piece of fabric.

Referring now to FIGS. 6 and 7, yet another way of using one embodiment of the present invention is illustrated. More specifically, the template 100 as described thus far may be employed, as will be appreciated by one skilled in the art, to create any number of multi-layered fabric designs. Further, a method of creating a larger triangle to be interconnected to a second fabric square is provided. Here, two fabric squares 148*a*, 148*b* are cut to any predetermined dimension for every folded corner required, block 168. The first fabric square 148*a* and the second fabric square 148*b* are placed together and their edges and corners are aligned, block 172. (FIG. 7A) Next, removable portions 140 of the backing 116 of the template 100 are removed, block 176, (FIG. 7B) and the template 100 is placed upon the layered fabrics, wherein the front sides 152*a*, 152*b* of both fabric squares 148*a*, 148*b* are placed together, block 184. The template 100 is located in such a way that the perforated line 108 spans from one corner to a diagonal corner of the layered fabric.(FIG. 7C) Again, portions of the template 100 may not contact any portion of the fabric such that the overlapping portion may be folded around the first fabric square 148*a* and the second fabric square 148*b* together and interconnected to the second fabric square to maintain the template in place, block 182. Next, the user sews the first fabric square 149*a* and the second fabric square 149*b* along the perforated line 108 of the template 100, block 188. The user then cuts along the indicated cut line 120 of the template 100 thereby separating portions of the first fabric square 148*a* and the second fabric square 148*b* from the assembled layered fabric, block 192. (FIG. 7D) The template 100, being further perforated by the sewing process, would then be easily removed, block 196. Finally, the first fabric square 148*a* is folded to expose its front side 152*a* and the assembly is pressed to provide a single fabric assembly to be used in a quilting block, block 204. (FIG. 7E)

Referring now to FIGS. 8-11, yet another embodiment of a template 100 is shown. Here, a generally rectangular template is provided that includes the cut line 120, two perforated lines 108 and various full cut lines 114. Again, as in the other embodiment of the present invention, logos 132, instructions and sizes 128 may be also provided on the template 100 to aid in the alteration of a fabric square. Further, kiss cuts 144 may also be provided on the rear side 136 of the template 100 to aid in the removal of portions of the backing 116 to selectively expose adhesive. The full cut lines 114 provided allow for the template to be selectively split to provide a slot 208 where to that received portions of the fabric square 148, which will be described in further detail below. In addition, perforated or cut lines 134 may be employed on the edges of the template 100 thereby allowing for a plurality of templates 100 to be interconnected in a roll for storage.

Figure 12:
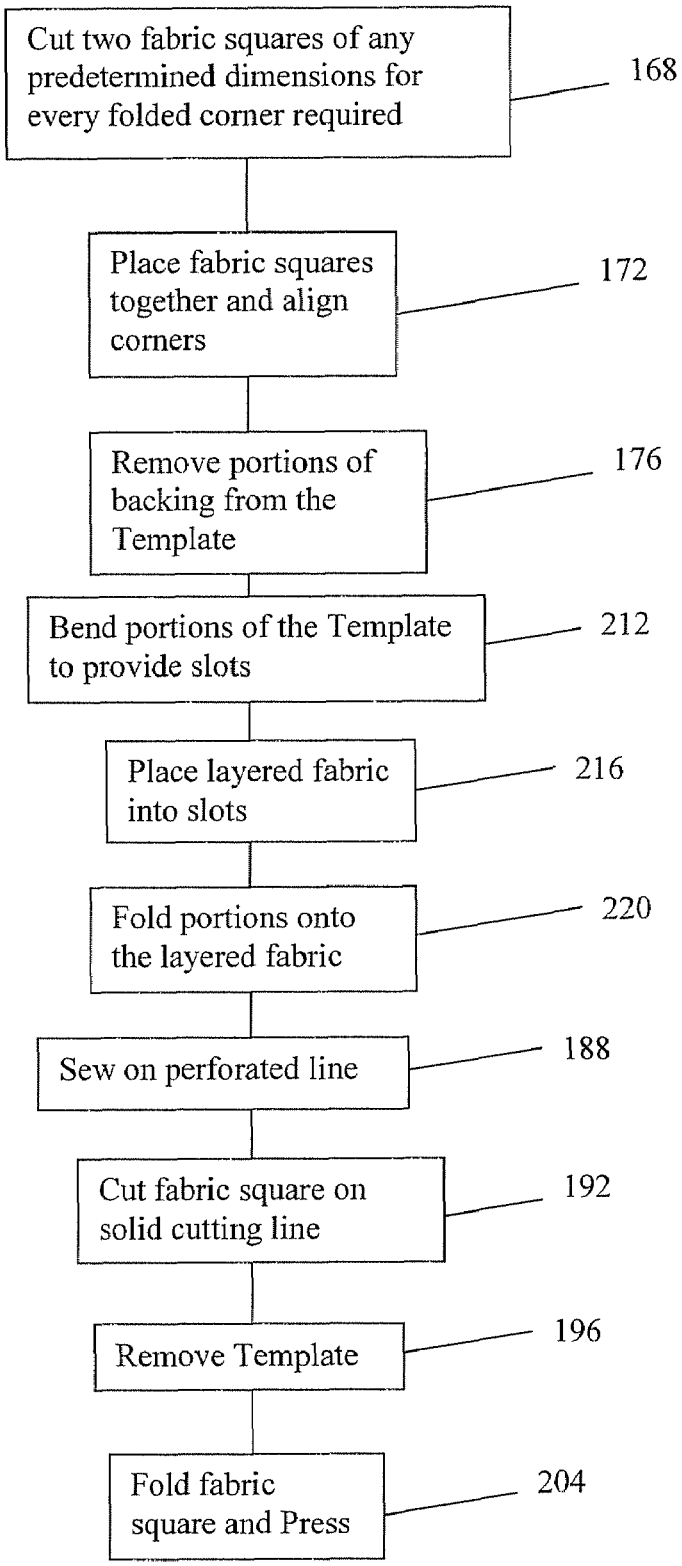
FIG. 12 is a flow diagram illustrating the method of using the embodiment of the present invention shown in FIG. 8.
Figure 13G:
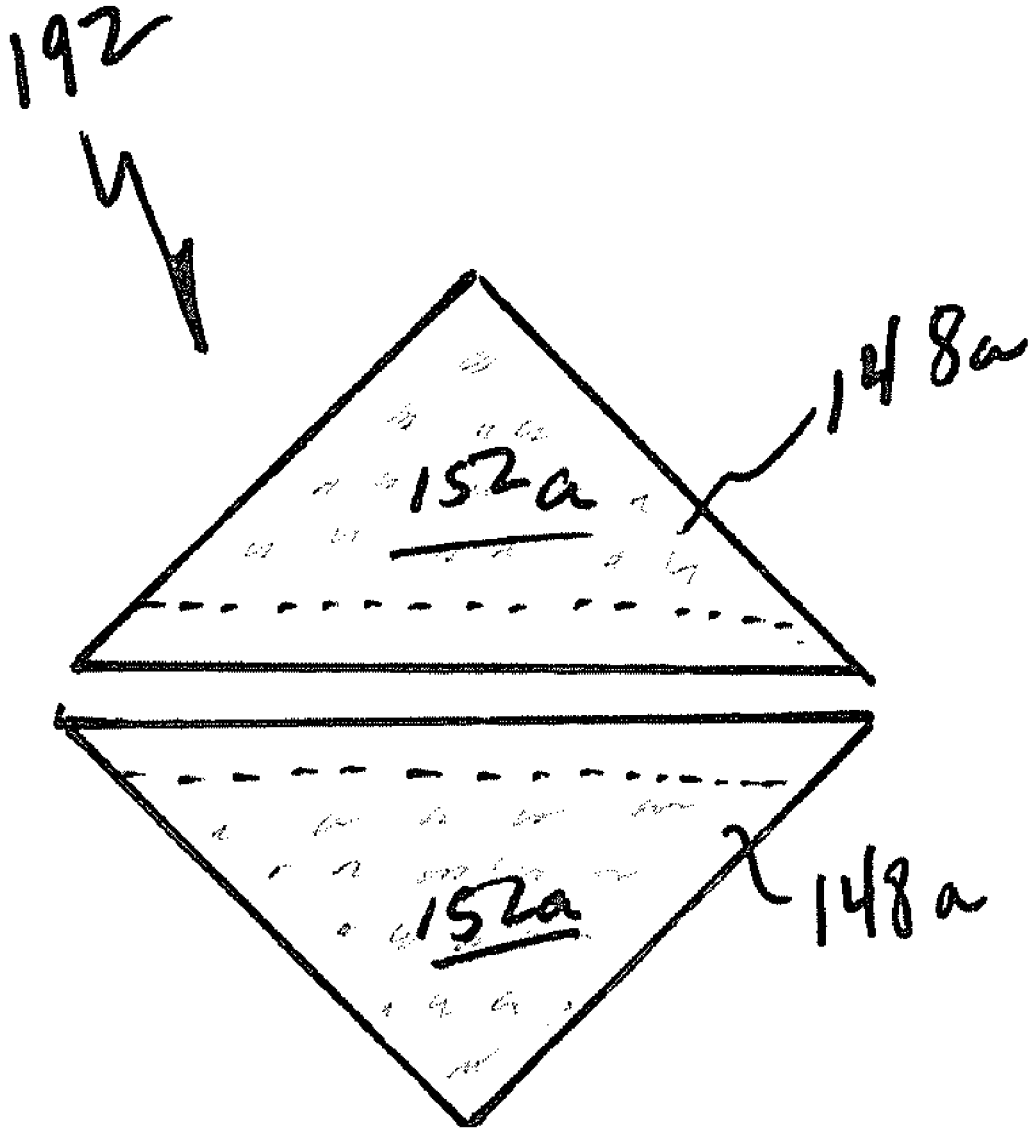
FIG. 13 is a series of pictorial representations of the flow shown in FIG. 8.

Referring now to FIGS. 12 and 13, a method of using another embodiment of the present invention is shown. Here, the first fabric square 148*a* and the second fabric square 148*b* are cut to a predetermined dimension for every folded corner required, block 168. The first fabric square 148*a* and the second fabric square 148*b* are then aligned, where each edge and corner are matched and the front side 152*a* of the first fabric square 148*a* and the front side 152*b* of the second fabric square 148*b* are engaged, block 172. (FIG. 13A) Portions of the backing 116 of the template 100 are removed and portions of the template are folded thereby providing slots 208 that receive the layered fabric, block 212. (FIGS. 13B & 13C) The formation of bends and slots 208 are facilitated via the use of full cut lines integrated into the template 100. The layered fabric is then placed within the template 100 wherein a portion, for example, a corner thereof is placed within the slot 208, block 216. (FIG. 3D) Next, the portion of the template 100 with the exposed adhesive is folded onto the back side 156*a* of the first fabric square 148*a* and affixed thereto to position and secure the template 100 onto the layered fabric, thereby ensuring that the template will not substantially move during the sewing of the first fabric square 148*a* to the second fabric square 148*b*, block 220.(FIG. 13E) Next, the fabric squares are sewn together along the two perforated lines 108 provided on the template 100 to interconnect the first fabric square 148*a* and the second fabric square 148*b* along two distinct lines, block 188. (FIG. 13F) The sewn together layered fabric is then cut along the cut line 120 shown on the template 100 thereby separating the layered fabric into two assemblies of layered fabric each interconnected by the previously described stitch lines, block 192. (FIG. 13G) The severed portions of the template 100 are removed, the fabric square folded to expose the front surfaces 152*a*, 152*b* of each of the first fabric square 148*a* and the second fabric square 148*b*, and the new fabric square assembly pressed to provide a quilting block component with at least two distinct designs, blocks 196 and 204. (FIG. 13H)

Referring now to FIGS. 1-13, a method of making the template 100 contemplated by the present invention is described. Embodiments of the present invention employ paper having adhesive provided on one side. The backing sheet 116 is interconnected to the paper thereby allowing for selective exposure of the adhesive. One skilled in the art will appreciate that the template 100 may be cut into any shape to facilitate the creation of quilting blocks. That is, although trapezoidal and rectangular templates are shown herein, various other shapes may be employed without departing from the scope of the invention. In addition, kiss cuts 144 are provided that allow for easier removal of the backing and edge perforations 134 are provided that allow for removal of one template 100 from another.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of selectively altering a piece of fabric comprising:

providing a first fabric piece;

providing a second fabric piece;

contacting said first and second fabric pieces to form a layered fabric;

providing a template, said template having first and second sides, the second side having adhesive thereon;

positioning and adhering said template onto at least one of said first and second fabric pieces; and stitching said template, said first fabric piece, and said second fabric piece together.

2. The method of claim 1 further comprising:

severing said template and at least one of said first fabric piece and said second fabric piece.

3. The method of claim 1, further comprising:

mating a decorative side of said first fabric piece, said first fabric piece being generally square, with a decorative side of said second fabric piece, said second fabric piece being generally square and larger that said first fabric piece;

wherein said layering comprises aligning at least two edges and at least one corner of said first fabric piece and said second fabric piece;

wherein said template further comprises a cut line and a perforated line, which is positioned substantially between a top edge and a second edge of said template, said perforated line indicating a location for said stitching;

severing said first fabric piece and said second fabric piece along said cut line;

removing said template from said layered fabric; and folding said first fabric piece to expose said decorative side of said first fabric piece and said decorative side of said second fabric piece thereby forming a quilt member.

4. The method of claim 1, wherein said template is trapezoidal having a top edge, a bottom edge and two lateral edges that are positioned an acute angle relative to said bottom edge.

5. The method of claim 1, wherein said template includes at least one of an instruction, a size indicator and a logo.

6. The method of claim 1, wherein said template includes score lines that facilitate the selective removal of backing material interconnected to said adhesive.

7. The method of claim 1, further comprising:

mating a decorative side of said first fabric piece, said first fabric piece being generally square, with a decorative side of said second fabric piece, said second fabric piece being generally square and substantially the same size as said first fabric piece;

wherein said layering comprises aligning at least two edges and at least one corner of said first fabric piece and said second fabric piece;

folding portions of said template around said layered fabric and interconnecting portions of said template onto said second fabric piece;

wherein said template further comprises a cut line and a perforated line that is positioned substantially between a top edge and a second edge of said template, said perforated line indicating a location for said stitching;

severing said first fabric piece and said second fabric piece along said cut line;

removing said template from said layered fabric; and folding said first fabric piece to expose said decorative side of said first fabric piece and said decorative side of said second fabric piece thereby forming a quilt member.

8. A method of selectively altering a piece of fabric comprising:

providing a first fabric piece;

providing a second fabric piece;

contacting at least one of said first and second fabric pieces to form a layered fabric;

providing a template having first and second sides with adhesives on at least one of said first and second sides;

folding and tearing said template in predetermined locations to provide at least one slot for the receipt of at least one edge of at least one of the first and second fabric pieces of said layered fabric;

interconnecting said template to said layered fabric; and stitching said template, said first fabric piece and said second fabric piece together.

9. The method of claim 8, further comprising:

mating a decorative side of said first fabric piece, said first fabric piece being generally square, with a decorative side of said second fabric piece, said second fabric piece being generally square;

wherein said layering comprises aligning at least two edges and at least one corner of said first fabric piece and said second fabric piece;

wherein said template further comprises two cut lines and a perforated line that is positioned substantially between a top edge and a bottom edge of said template, said perforated line indicating a location for said stitching;

folding portions of said template around said layered fabric and interconnecting portions of said template onto at least one of said first fabric piece and said second fabric piece;

severing said first fabric piece and said second fabric piece along said cut lines;

removing said template from said layered fabric; and folding said first fabric piece to expose said decorative side of said first fabric piece and said decorative side of said second fabric piece thereby forming two quilt members.

10. The method of claim 8, wherein said template is rectangular.

11. The method of claim 8, wherein said template includes at least one of an instruction, a size indicator and a logo.

12. The method of claim 8, wherein said template includes score lines that facilitate the selective removal of backing material interconnected to said adhesive.

13. A template for selectively altering fabric, comprising:

a sheet having a first side and a second side, said template being defined by at least first and second edges;

a perforated sewing line located between said first and said second edges;

a cut line located between said first and second edges;

a backing sheet interconnected to said second side, said backing sheet being cut thereby allowing selective removal of said backing sheet from said second side; and at least one score line integrated into said sheet to facilitate bending of said sheet.

14. The template of claim 13 further comprising at least one of an instruction, a size indicator and a logo.

15. The template of claim 13 wherein said two lateral edges are adapted to selectively interconnect to another template.

16. The template of claim 13 wherein said lateral edges are positioned at an acute angle relative to said bottom edge.

17. The template of claim 13 wherein said lateral edges are positioned at right angles relative to said top edge and said bottom edge.

18. The template of claim 13 wherein said score lines are adapted to selectively tear said template to provide slots for the receipt of a piece of fabric.

* * * * *